US006305298B1

(12) United States Patent
Kaufhold et al.

(10) Patent No.: US 6,305,298 B1
(45) Date of Patent: Oct. 23, 2001

(54) LIGHT WEIGHT DRAFT SILL

(75) Inventors: Horst T. Kaufhold, Aurora; Douglas L. Compton; Brian A. Toussaint, both of Bolingbrook; Ronald G. Butler, Jr., Mundelein; Jeffery R. Ladendorf, Mount Prospect, all of IL (US)

(73) Assignee: AMSTED Industries Incorporated, Chicago, IL (US)

( * ) Notice: Subject to any disclaimer, the term of this patent is extended or adjusted under 35 U.S.C. 154(b) by 0 days.

(21) Appl. No.: 09/283,081

(22) Filed: Mar. 31, 1999

Related U.S. Application Data

(63) Continuation-in-part of application No. 08/885,643, filed on Jun. 30, 1997, now Pat. No. 5,931,101.

(51) Int. Cl.[7] ..... B61D 17/00

(52) U.S. Cl. ..... 105/420; 105/199.4; 105/415; 105/421; 105/228; 213/50.5; 213/51; 213/57

(58) Field of Search ..... 105/420, 421, 105/199.4, 228, 415; 213/50.5, 51, 57

(56) References Cited

U.S. PATENT DOCUMENTS

| | | | | |
|---|---|---|---|---|
| 779,038 | | 1/1905 | Guinn | 213/66 |
| 929,245 | | 7/1909 | Pulliam | 213/51 |
| 929,246 | | 7/1909 | Pulliam | 213/51 |
| 970,128 | | 9/1910 | Shallenberger | 213/51 |
| 1,074,709 | | 10/1913 | Gaines | 213/51 |
| 2,638,233 | | 5/1953 | Wolfe | 105/420 |
| 3,561,370 | | 2/1971 | Reynolds | 213/57 |
| 3,703,239 | | 11/1972 | Furniss | 213/57 |
| 3,973,681 | * | 8/1976 | Martin et al. | 213/8 |
| 4,029,022 | | 6/1977 | McClurg | 105/420 |
| 4,042,117 | | 8/1977 | McClurg | 213/50.5 |
| 4,128,062 | * | 12/1978 | Roberts | 105/420 |
| 4,252,068 | * | 2/1981 | Nolan | 105/420 |
| 4,359,003 | * | 11/1982 | Miller et al. | 105/420 |
| 4,445,617 | | 5/1984 | Elliott | 105/420 |
| 4,549,666 | | 10/1985 | Altherr et al. | 105/420 |
| 5,135,117 | | 8/1992 | Geis | 213/57 |
| 5,704,296 | * | 1/1998 | Gagliardino et al. | 105/420 |
| 5,927,521 | | 7/1999 | Downes et al. | 213/62 R |
| 5,931,101 | * | 8/1999 | Kaufhold et al. | 105/420 |
| 5,943,964 | * | 8/1999 | Downes et al. | 105/3 |

OTHER PUBLICATIONS

Amsted Industries, Inc., Second Admitted Prior Art Draft Sill End Casting, Oct. 27, 2000, pp. 1–5.

Association of American Railroads—Mechanical Division "The Car and Locomotive Cyclopedia of American Practices," 1st edition 1966, pp. 627, 675.

(List continued on next page.)

*Primary Examiner*—Russell D. Stormer
*Assistant Examiner*—Frantz F. Jules
(74) *Attorney, Agent, or Firm*—Edward J. Brosius

(57) ABSTRACT

The present invention provides a lightweight draft sill end casting for use with railroad cars. The cast draft sill has side walls, front and rear stops, front and rear rib sets and a center plate that are cast as a unit. The draft sill has an open area between the tops of the side walls between the front and rear stops, with a cast metal span connecting the two side walls. The cast metal span may comprise one or more spacer bars or part of a top wall. The cast metal span is in the area between the planes of the front stops and the rear stops. The front and rear stops are spaced below the tops of the side walls. In one embodiment, there are additional lightener holes in each side wall between the ribs in the rear rib set and in the pocket. The total weight of the cast draft sill is not substantially greater than the weight of a comparable fabricated draft sill of substantially the same size, and has a greater fatigue life. The total open area connecting the interior and the exterior of the draft sill between the front stop plane and the rear stop plane is at least 130 square inches.

42 Claims, 5 Drawing Sheets

OTHER PUBLICATIONS

Amsted Industries, Inc., Admitted Prior Art Draft Sill End Casting For Vertical Pin Drawbar, 2000, pp. 1–5.

Association of American Railroads—Mechanical Division "The Car and Locomotive Cyclopedia of American Practices," $6^{th}$ edition 1997, pp. vii, 662–663, 678–679.

Association of American Railroads—Mechanical Division "The Car and Locomotive Cyclopedia of American Practices," $4^{th}$ edition 1980, pp. 492, 493, 512, 513.

Association of American Railroads—Mechanical Division "The Car and Locomotive Cyclopedia of American Practices," 3rd edition 1974, pp. III, S8–25.

* cited by examiner

LIGHT WEIGHT DRAFT SILL

This is a continuation-in-part of U.S. patent application Ser. No. 08/885,643, filed on Jun. 30, 1997 and entitled "Light Weight Draft Sill", now U.S. Pat. No. 5,931,101, the complete disclosure of which is incorporated by reference herein in its entirety.

FIELD OF THE INVENTION

The present invention relates to cast draft sill structures and railroad car center sill structures.

BACKGROUND OF THE INVENTION

Draft sills have been used to receive and house coupler systems for coupling one railroad car to another. Buff and draft forces are generally transferred between the draft sill structure, the car truck and the center sill of the car. More particularly, the draft sill structure typically receives a coupler and a yoke or other coupler mounting structure such as a draw bar and a cushioning or shock-absorbing assembly.

Continued attempts have been made to decrease the weight of railroad cars to allow for reduced energy consumption and more efficient rail transport. It has been desirable to produce railroad freight car components that are relatively lightweight and that can accommodate new car designs. In some instances, attempts have been made to reduce the weight of the draft sills themselves. Attempts have been made to produce lighter weight fabricated draft sills instead of using cast draft sill structures.

Typical fabricated sills have front and rear stops, ribs and center plate that are welded into place between side walls in the draft sill. The fabricated structure has been welded to a shear plate on the underside of the railroad car. Fabricated draft sills have typically had the advantage of being lighter in weight than cast draft sills, but have also had the disadvantage of having a generally shorter fatigue life compared to cast draft sills, due in part to increased stresses at the numerous welds in the fabricated sills.

The Association of American Railroads (AAR) has set requirements for the strength of draft sill structures. For example, the rear stops must be capable of withstanding a 1000 Klbs static buff load without failure, and future AAR requirements will require that the front stops be capable of withstanding a 900 Klbs static draft force. Given these strength requirements, it has been problematic to provide a lightweight cast draft sill that meets AAR strength requirements.

SUMMARY OF THE INVENTION

The present invention provides a lightweight cast draft sill for use in railroad cars having a shear plate. The lightweight cast draft sill of the present invention can be used in place of a standard fabricated draft sill while meeting the car builder's weight and strength requirements.

In one aspect, the present invention provides a draft sill to receive a shank of a device for connecting one railroad car to another. The draft sill comprises a front end and a back end and a pair of spaced side walls. Each side wall has a top and a bottom. The side walls have facing inner surfaces and extend substantially from the front end to the back end of the draft sill. At least parts of the tops of the side walls lie in a top plane. The draft sill has a central longitudinal plane between the side walls. The draft sill also has a center plate and an open member positioned along the central longitudinal plane of the draft sill. The open member has a generally vertical central longitudinal axis intersecting the center plate. The central longitudinal axis of the open member extends upward between the side walls between the front and back ends of the draft sill. The draft sill has a plurality of generally vertical ribs, a pair of front stops and a pair of rear stops. There is one front stop on the inner surface of each side wall. At least parts of the front stops are aligned along a front stop plane that intersects the draft sill central longitudinal plane. There is one rear stop on the inner surface of each side wall. At least parts of the rear stops are aligned along a rear stop plane that intersects the draft sill central longitudinal plane. The front and rear stops are spaced apart. The front stop plane is between the rear stop plane and the front end of the draft sill. The rear stop plane is between the back end of the draft sill and the front stop plane. The rear stop plane is between the vertical ribs and the front stop plane and is between the open member and the front stop plane. The draft sill has a front rib set that extends from each front stop to the inner surface of the adjacent side wall and toward the front end of the draft sill. The draft sill also has a rear rib set that extends from each rear stop to the inner surface of the adjacent side wall and toward the back end of the draft sill. A flange extends outward from the bottom of each side wall. Each flange has a top surface and a bottom surface. The draft sill has an interior between the inner surfaces of the side walls and an exterior beyond the side walls and beyond the top plane. At least one open area connects the interior of the draft sill and the exterior of the draft sill. The open area is above the level of the top surfaces of the flanges and includes at least one open area between the tops of the side walls and between the front stop plane and rear stop plane of the draft sill. The draft sill further includes at least one metal span connecting the side walls. The total open area connecting the interior and exterior of the draft sill above the level of the top surfaces of the flanges and between the front stop plane and a position inward of the back end of the draft sill is at least 130 square inches. At least the front stops, rear stops, front and rear rib sets, side walls and metal span comprise a unitary cast structure. The total weight of the draft sill including the side walls, connecting metal span, front and rear stops, front and rear rib sets, center plate, open member and vertical ribs is not substantially greater than the weight of a comparable fabricated draft sill of substantially the same size and having side walls, front and rear stops, front and rear rib sets, a center plate, an open member and vertical ribs.

In another aspect, the present invention provides a draft sill to receive a shank of a device for connecting one railroad car to another. The draft sill comprises a front end, a back end and a pair of spaced side walls. Each side wall has a top and a bottom. At least parts of the tops of the side walls lie in a top plane. The two side walls have facing inner surfaces and also have exterior surfaces. The side walls extend substantially from the front end to the back end of the draft sill. The draft sill has a central longitudinal plane between the side walls and a center plate. An open member is positioned along the central longitudinal plane of the draft sill and has a generally vertical central longitudinal axis intersecting the center plate. There are a plurality of generally vertical ribs. The draft sill has a pair of front stops and a pair of rear stops. One front stop and one rear stop is on the inner surface of each side wall. At least parts of the front stops are aligned along a front stop plane. At least parts of the rear stops are aligned along a rear stop plane. The front and rear stops are spaced apart. The front stop plane is between the rear stop plane and the front end of the draft sill. The rear stop plane is between the back end of the draft sill and the front stop plane. The rear stop plane is between the vertical ribs and the front stop plane. The rear stop plane is between the open member and the front stop plane. A front rib set extends from each front stop to the adjacent side wall and toward the front end of the draft sill. A rear rib set extends from each rear stop to the adjacent side wall and toward the back end of the draft sill. A flange extends outward from the bottom of each side wall. Each flange has a top surface and a bottom surface. The draft sill has an interior between the inner surfaces of the side walls and an exterior beyond the exterior surfaces of the side walls and beyond the top plane. At least one open area connects the interior and the exterior of the draft sill. The draft sill includes at least one metal span connecting the side walls. The total open area connecting the interior and exterior of the draft sill above the level of the top surfaces of the flanges and between the front stop plane and a position inward of the back end of the draft sill is at least 130 square inches. The total open area connecting the interior and exterior of the draft sill above the level of the top surfaces of the flanges includes at least one open area between the front stop plane and the rear stop plane and between the tops of the side walls. At least part of at least one of the open member and the vertical ribs lies between the side walls. At least the front stops, rear stops, front and rear rib sets, side walls and metal span comprise a unitary cast structure. The total weight of the draft sill including the side walls, connecting metal span, front and rear stops, front and rear rib sets, center plate, open member and vertical ribs is not greater than 1255 pounds.

In another aspect, the present invention provides a draft sill of relatively lightweight construction for use with a railway car having a center sill with two ends. The draft sill is to be positioned at one end of the center sill and comprises a front end, a back end and a pair of spaced side walls. Each side wall has a top and a bottom. At least parts of the tops of the side walls lie in a top plane. The side walls have facing inner surfaces and exterior surfaces. The facing inner surfaces of the side walls define an interior of the draft sill. The draft sill has an exterior beyond the exterior surfaces of the side walls and the top plane. There is a draft sill central longitudinal plane between the side walls. There are a pair of front stops. One front stop is on the inner surface of each side wall. At least parts of the front stops are aligned along a front stop plane intersecting the draft sill central longitudinal plane. There are a pair of rear stops. One rear stop is on the inner surface of each side wall. At least parts of the rear stops are aligned along a rear stop plane intersecting the draft sill central longitudinal plane. The front and rear stops are spaced apart. The front stops are between the rear stops and the front end of the draft sill. The rear stops are between the back end of the draft sill and the front stops. There is a center plate and an open member aligned with the center plate. The draft sill has at least one open area between the tops of the side walls. The open area connects the interior of the draft sill and the exterior of the draft sill. The draft sill has at least one metal span connecting the side walls. At least the front stops, rear stops, side walls and metal span comprise a unitary cast draft sill structure. The draft sill central longitudinal plane intersects the open area between the tops of the side walls. The total open area between the tops of the side walls along the draft sill central longitudinal plane and between the front stop plane and rear stop plane has a total length along the draft sill central longitudinal plane. This total length is at least one half the distance between the planes of the front and rear stops. The total open area between the tops of the side walls along a transverse plane intersecting the side walls and open area between the front stop plane and rear stop plane has a total width along the transverse plane. This total width is at least one third the distance between the side walls along the transverse plane. The open member has a central longitudinal axis that extends between the side walls of the draft sill. The total open area connecting the interior and the exterior of the draft sill between the front stop plane and rear stop plane is at least 130 square inches.

In another aspect, the present invention provides a draft sill of relatively lightweight construction for use with a railway car having a center sill with two ends. The draft sill is to be positioned at one end of the center sill. The draft sill comprises a front end, a back end and a pair of spaced side walls. Each side wall has a top and a bottom. At least parts of the tops of the side walls lie in a top plane. The side walls have facing inner surfaces and exterior surfaces. The draft sill has a central longitudinal plane between the side walls. A center plate is positioned along the central longitudinal plane and has a longitudinal dimension and a transverse dimension. An open member is positioned along the central longitudinal plane of the draft sill and has a generally vertical central longitudinal axis intersecting the center plate. There are a pair of front stops and a pair of rear stops. One front stop and one rear stop is on the inner surface of each side wall. At least parts of the front stops are aligned along a front stop plane intersecting the draft sill central longitudinal plane. At least parts of the rear stops are aligned along a rear stop plane intersecting the draft sill central longitudinal plane. The front and rear stops are spaced apart. The front stop plane is between the rear stop plane and the front end of the draft sill. The rear stop plane is between the back end of the draft sill and the front stop plane. The rear stop plane is between the open member and the front stop plane. The central longitudinal axis of the open member is between the rear stop plane and the back end of the draft sill. A front rib set extends from each front stop to the inner surface of the adjacent side wall and toward the front end of the draft sill. A rear rib set extends from each rear stop to the inner surface of the adjacent side wall and toward the back end of the draft sill. The central longitudinal axis of the open member lies in a transverse center plate plane parallel to the front stop plane and rear stop plane and between the rear stop plane and back end of the draft sill. A flange extends outward from the bottom of each side wall. Each flange has a top surface and a bottom surface. The draft sill has a transverse dimension along the transverse center plate plane. The maximum transverse dimension of the draft sill exclusive of the flanges along the transverse center plate plane is less than the maximum transverse dimension of the draft sill including the flanges and along the transverse center plate plane. The draft sill has an interior between the inner surfaces of the side walls and an exterior beyond the exterior surfaces of the side walls and beyond the top plane. At least one open area connects the interior of the draft sill and the exterior of the draft sill. The open area is above the level of the top surfaces of the flanges. The total open area connecting the interior and exterior of the draft sill above the level of the top surfaces of the flanges and between the front stop plane and rear stop plane is at least 130 square inches. The total open area connecting the interior and exterior of the draft sill above the level of the top surfaces of the flanges includes at least one open area between the front stop plane and the rear stop plane and between the tops of the side walls. At least the front stops, rear stops, front and rear rib sets, side walls, flanges and metal span comprise a unitary cast structure.

DETAILED DESCRIPTION

Figure 6:
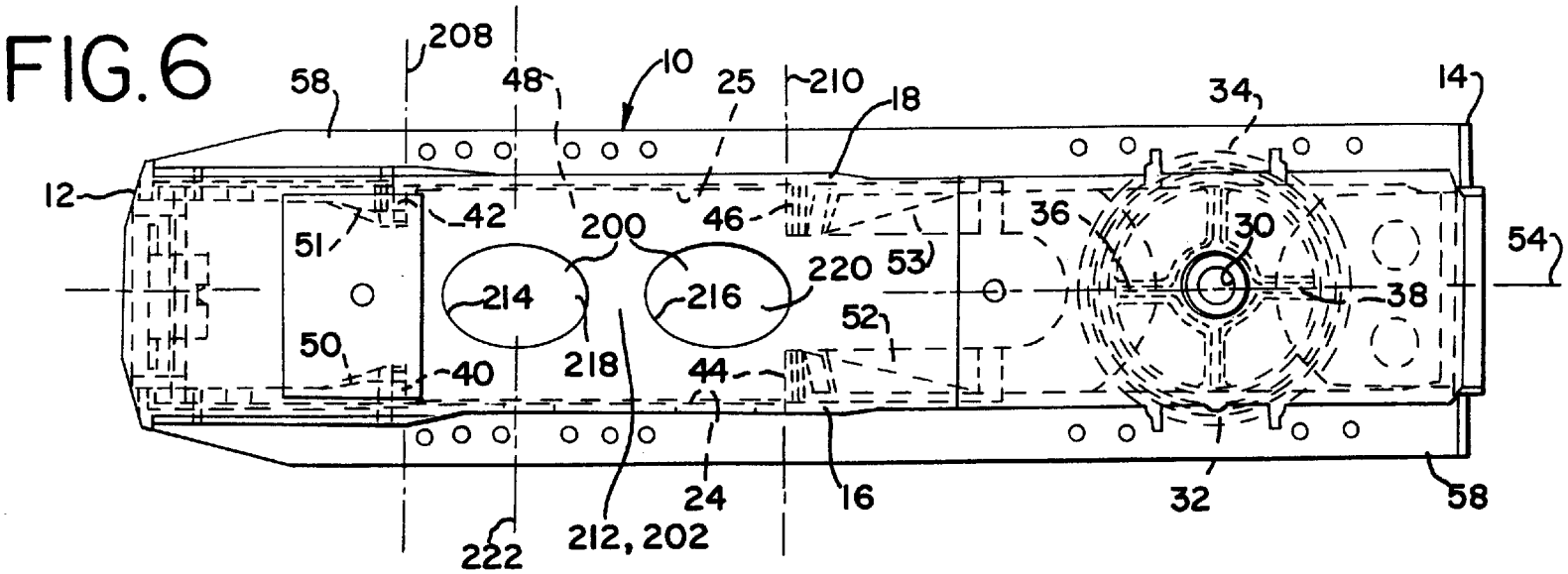
FIG. 6 is a top plan view of another embodiment of the cast draft sill of the present invention.
Figure 7:
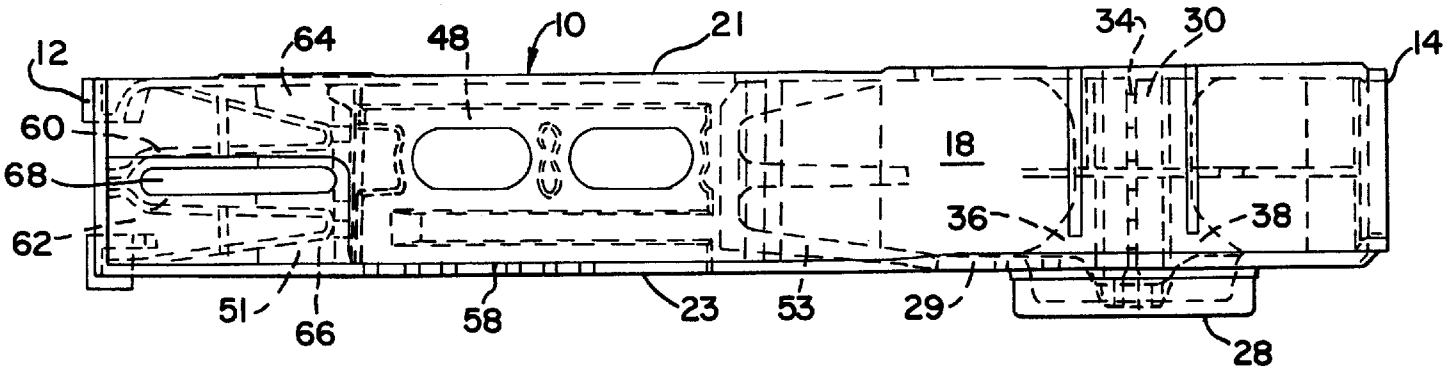
FIG. 7 is a side elevation of the cast draft sill of FIG. 6.
Figure 8:
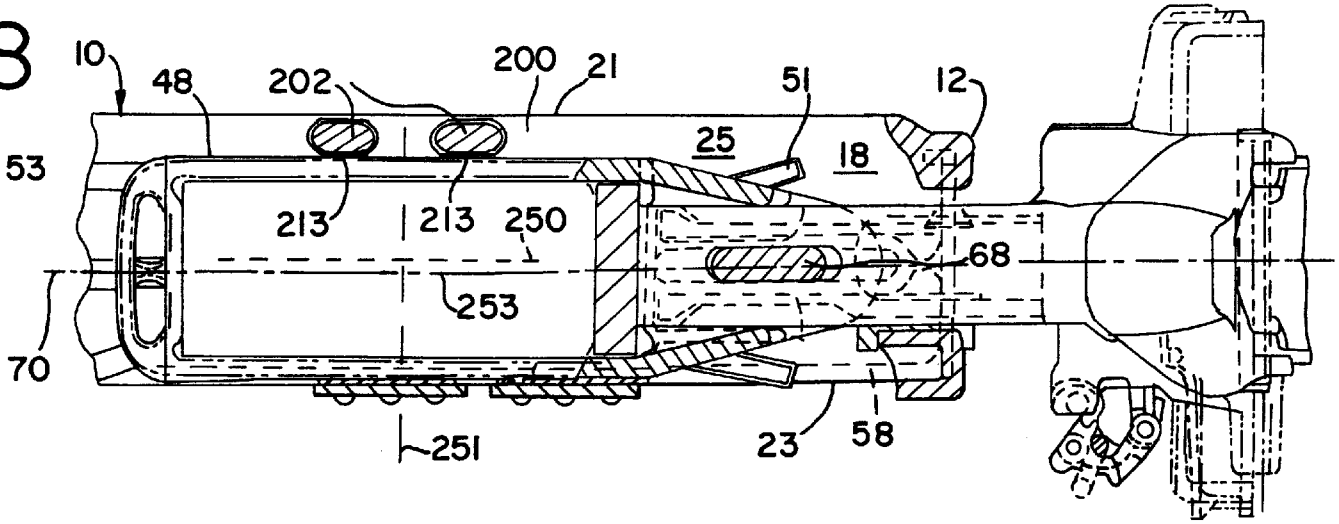
FIG. 8 is a cross-section of a portion of the draft sill of the first embodiment, shown with a standard E-type coupler received in the draft sill and with a draft gear shown generally within a yoke in the pocket.
Figure 9:
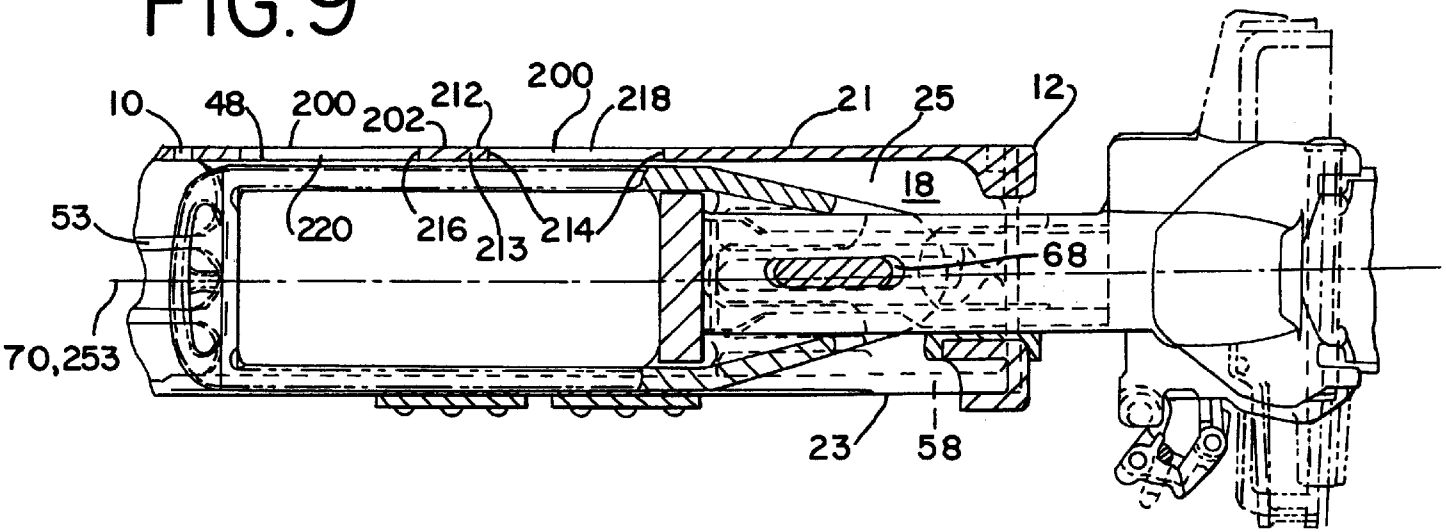
FIG. 9 is a cross-section of a portion of the draft sill of the second embodiment, shown with a standard E-type coupler received in the draft sill and with a draft gear shown generally within a yoke in the pocket, and also shown without the front and rear stops and front and rear ribs of the invention.

A first embodiment of the cast draft sill of the present invention is shown in FIGS. 1–5, 8 and 10–11. A second embodiment of the cast draft sill of the present invention is shown in FIGS. 6–7 and 9. FIG. 6 corresponds with FIG. 18 of U.S. patent application Ser. No. 08/885,643, filed on Jun. 30, 1997 by Horst T. Kaufhold, Douglas L. Compton, Brian A. Toussaint and Ronald G. Butler and entitled "Light Weight Draft Sill", the complete disclosure of which is incorporated by reference herein. The FIG. 6 embodiment may have the structures as disclosed in application Ser. No. 08/885,643 for the embodiment of FIG. 18.

The draft sill of the present invention is to receive a shank of a device for connecting one railroad car to another, as disclosed in application Ser. No. 08/885,643. Although FIGS. 1–4 and 6–10 illustrate a cast draft sill for use with an E-type coupler, it should be understood that many of the features of the present invention apply to F-type couplers as well.

In FIGS. 1–11, like numbers have been used for like parts, and the description of parts for one embodiment should be understood to apply to the other embodiment as well, unless specifically limited to one of the embodiments.

The draft sill 10 of the present invention has a front end 12 and a back end 14. A pair of spaced side walls 16, 18 extend substantially from the front end 12 to the back end 14. The side walls 16, 18 have tops 20, 21 bottoms 22, 23 and inner surfaces 24, 25 facing the interior 26 of the draft sill 10.

A center plate 28 extends downward from the bottom wall 29 of the draft sill 10. The center plate 28 is connected to the side walls 16, 18 between the front and back ends 12, 14 of the draft sill 10. An open member 30 extends up from the center plate 28 between the side walls 16, 18. The open member 30 has a central longitudinal axis 31 that is generally vertical when the draft sill is oriented as shown in FIGS. 1–9. Two generally vertical ribs 32, 34 extend radially outward from the open member 30 and are connected to the center plate 28 and to the side walls 16, 18. Two other generally vertical ribs 36, 38 extend radially outward from the open member 30, one vertical rib 36 toward the front end 12 of the draft sill and one vertical rib 38 toward the back end 14 of the draft sill. These two vertical ribs 36, 38 are also connected to the center plate 28.

As in standard draft sills, the open member 30 receives a king pin (not shown) that extends through a central opening in the center plate 28 and into a receiving opening in the railcar truck bolster (not shown). The draft sill of the present invention may be used with standard railcar trucks.

The draft sill 10 also has two opposed front stops 40, 42 and two opposed rear stops 44, 46 on the inner surfaces 24, 25 of the side walls 16, 18. The front stops 40, 42 extend from the side walls 16, 18 toward one another. The rear stops 44, 46 extend from the side walls 16, 18 toward one another.

The front stops 40, 42 are spaced from the rear stops 44, 46 and define a pocket 48 between them. The pocket 48 is typically referred to as a draft gear pocket, although it should be understood that cushioning systems other than draft gear assemblies may be held within the pocket 48. The front stops 40, 42 are positioned between the rear stops 44, 46 and the front end 14 of the draft sill, and the rear stops 44, 46 are between the front stops 40, 42 and the back end 14 of the draft sill. The center plate 28 and open member 30 are between the rear stops 44, 46 and the back end 14 of the draft sill. The pocket 48 is a space that may receive a shock-absorbing device, such as a draft gear, for use in conjunction with a coupler received through the front end of the draft sill. The illustrated draft sills may also be used with other conventional systems for connecting railroad cars together, such as a drawback assembly or other non-coupler type connecting device instead of a coupler, in which case the pocket 48 may be filled with some other structure.

Front rib sets 50, 51 extend from the front stops 40, 42 to the adjacent side walls 16, 18 and toward the front end 12 of the draft sill. Rear rib sets 52, 53 extend from the rear stops 44, 46 to the adjacent side walls 16, 18 and toward the rear end 14 of the draft sill.

The structures of both sides of the illustrated draft sills along their central longitudinal planes 54 are generally the same, that is, they are mirror images of one another, and a single side will be described. It should be understood that the following description of the front stop 42 and front rib set 51 apply to the opposing front stop 40 and front rib set 50 as well.

The front stop 42 has an inward-facing surface 56 that is dished at its center. In other words, the center of the inward-facing surface 56 of the front stop has a depression extending toward the adjacent side wall 18 from the which the stop extends, as shown and described in application Ser. No. 08/995,643. It should be understood that the front stop may be made with inward-facing surfaces of different shapes, such as a level surface. By providing the dished top surface, the illustrated cast draft sill may be used with both standard coupler assemblies as well as with non-coupler connecting devices, such as drawbars.

The illustrated front rib set 51 functions to distribute forces acting on the front stop 42 to the side wall 18, and to some extent to the flange 58 at the bottom 23 of the side wall 18. Each front rib set 51 includes top and bottom key slot ribs 60, 62, a top rib 64 and a bottom rib 66.

The illustrated draft sill is of the type designed for use with a standard E-type coupler, and the top and bottom key slot ribs 60, 62 are separated by a key slot 68. The key slot 68 has a central axis 70 that is co-planar with the central axis of the opposing key slot. The plane of the central axis 70 corresponds with a theoretical force line for the draft sill, that is, the line along which buff and draft forces are expected to be transmitted from the shank or butt end of the connecting device to the draft sill.

Figure 10:
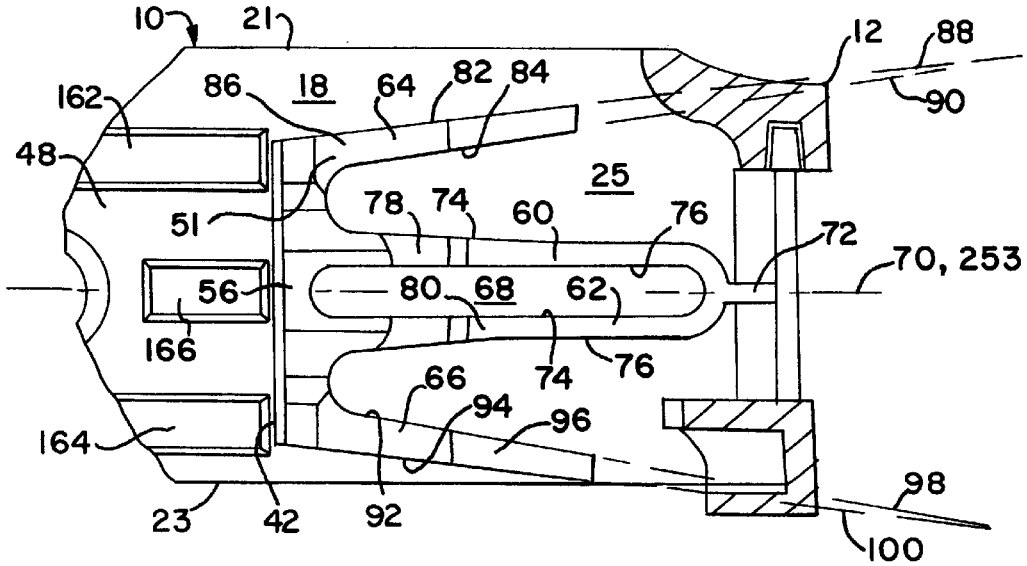
FIG. 10 is a cross-section taken along line 10—10 of FIG. 2, showing one of the front rib sets.

At the forward end of the key slot 68, the top and bottom key slot ribs 60, 62 join into a single rib 72 that extends to the front end 12 of the draft sill. As shown in FIG. 10, the ends of the key slot ribs 60, 62 near the back end of the key slot 68 are curved to join with the front stop 42. The key slot ribs 60, 62 have top and bottom surfaces 74, 76. The top surface 74 of the top key slot rib 60 and the bottom surface 76 of the bottom key slot rib 62 diverge outwardly toward the front stop 42. Inward facing surfaces 78, 80 of the top and bottom key slot ribs 60, 62 taper from high points at the juncture with the front stop 42 toward the side wall 18.

As shown in FIG. 10, the front top rib 64 extends from the front stop 42 toward the front end 12 of the draft sill 10 and to the adjacent side wall 18. The top rib 64 has upper and lower surfaces 82, 84 that join the front stop 42 at positions spaced from the top 21 of the side wall 18. The lower surface 84 and the front stop 42 are joined along a curved surface that also joins the front stop 42 to the top key slot rib 60. As shown in FIG. 10, the front top rib 64 is shaped so that planes 88, 90 parallel with lengths of the upper and lower surfaces 82, 84 of the top rib 64 define acute angles with the plane of the central axis 70 of the key slot 68; the acute angles may be the same, but need not be the same angle, as in the illustrated embodiment. The top surface 74 of the top rib 64 is spaced from the top 21 of the side wall 18, and the top rib 64 is the only rib between the top 21 of the side wall 18 and the top key slot rib 60. The inward-facing surface 86 of the top rib 64 tapers from a high point at the juncture with the front stop 42 toward the side wall 18. Compared to the front rib set shown in FIGS. 5 and 6 of application Ser. No. 08/885,643, there is no deep recess in the present front rib set and front stop, as the front stop 42 and front rib set 51 are spaced from the top 21 of the side wall 18.

The front bottom rib 66 extends from the front stop 42 toward the front end 12 of the draft sill and toward the bottom 23 of the side wall 18. The front bottom rib 66 also extends to and along the side wall 18. As shown in FIG. 10, the front bottom rib 66 has a top surface 92, a bottom surface 94 and an inward-facing surface 96. The top and bottom surfaces 92, 94 are shaped so that a plane 98 parallel with a length of the top surface 92 of the front bottom rib 66 defines an acute angle with the plane of the central axes 70 of the two key slots 68 and so that a plane 100 parallel with a length of the bottom surface 94 of the front bottom rib 66 defines an acute angle with the plane of the central axes 70 of the two key slots 68. The front bottom rib 66 is the only rib between the bottom key slot rib 62 and the bottom 23 of the side wall 18. The top surface 92 of the front bottom rib 66 joins the front stop 42 along a curved surface that also joins the bottom key slot rib 62 to the front stop 42. The bottom surface 94 of the front bottom rib 66 meets the front stop 42 at a position spaced from the plane of the bottoms 22, 23 of the two side walls 16, 18. The forward end of the bottom surface 94 of the front bottom rib 66 meets the bottom 23 of the side wall 18. The top surface 92 of the front bottom rib 66 has a forward end spaced from the transverse carrier rib 102 of the draft sill.

Figure 2:
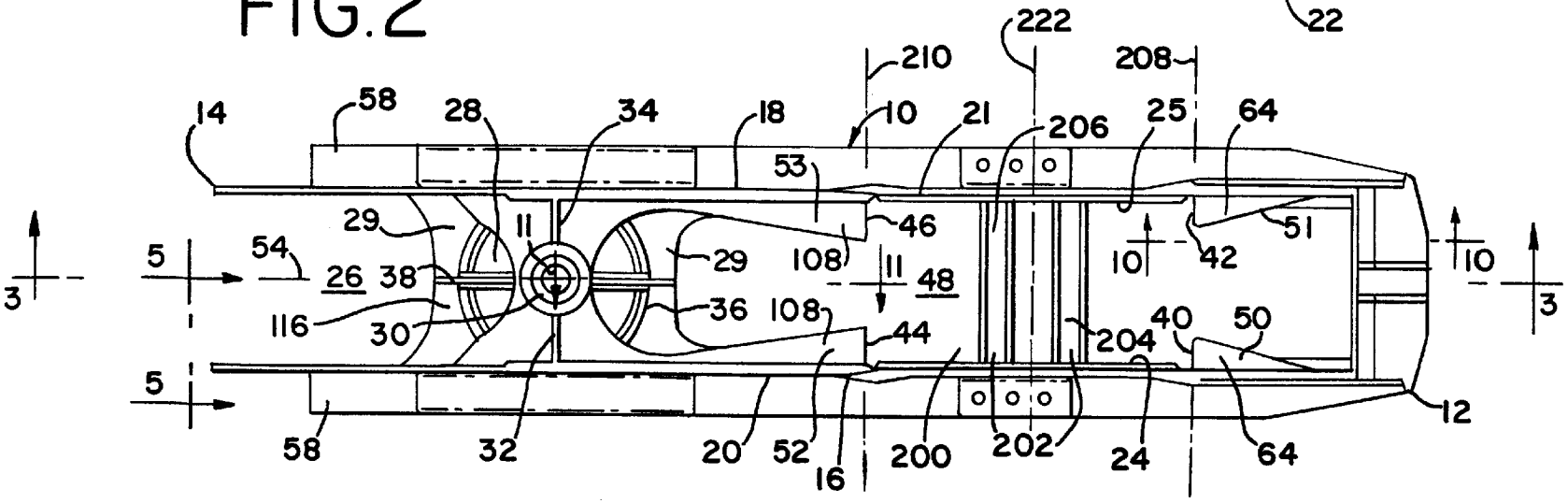
FIG. 2 is a top plan view of the cast draft sill of FIG. 1.
Figure 3:
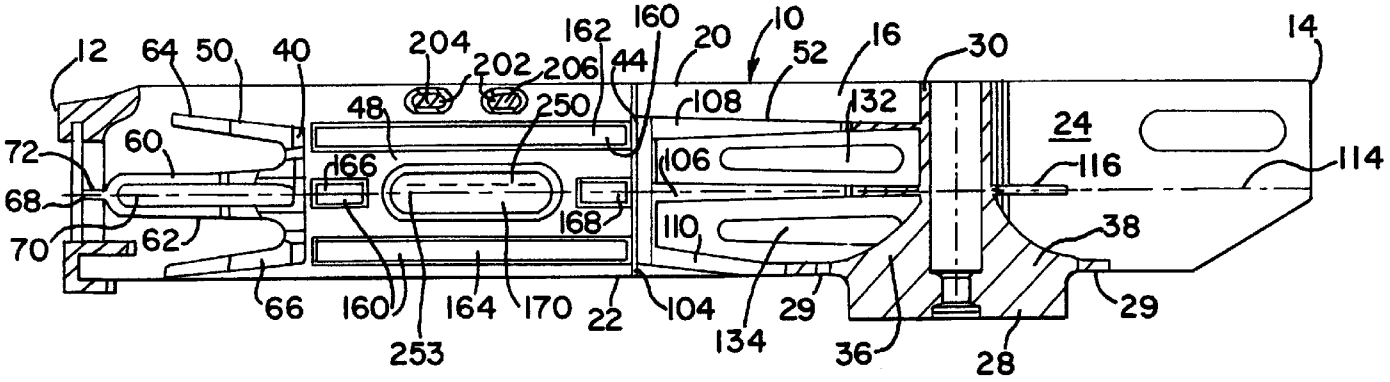
FIG. 3 is a cross-section of the cast draft sill of FIGS. 1–2, taken along line 3—3 of FIG. 2 and turned 180°.

As shown in FIG. 2, the opposed rear stops 44, 46 extend from the inner surfaces 24, 25 of the two side walls 16, 18 toward the interior 26 of the draft sill. The rear stops are spaced from both the tops 20, 21 and bottoms 22, 23 of the side walls 16, 18. Also as shown in FIG. 3, there is an elongate cut-out or depression 104 at the juncture of each rear stop and the adjacent side wall, at the forward face of the rear stop. The depressions 104 extend from the tops 20, 21 to the bottoms 22, 23 of the side walls 16, 18.

Figure 11:
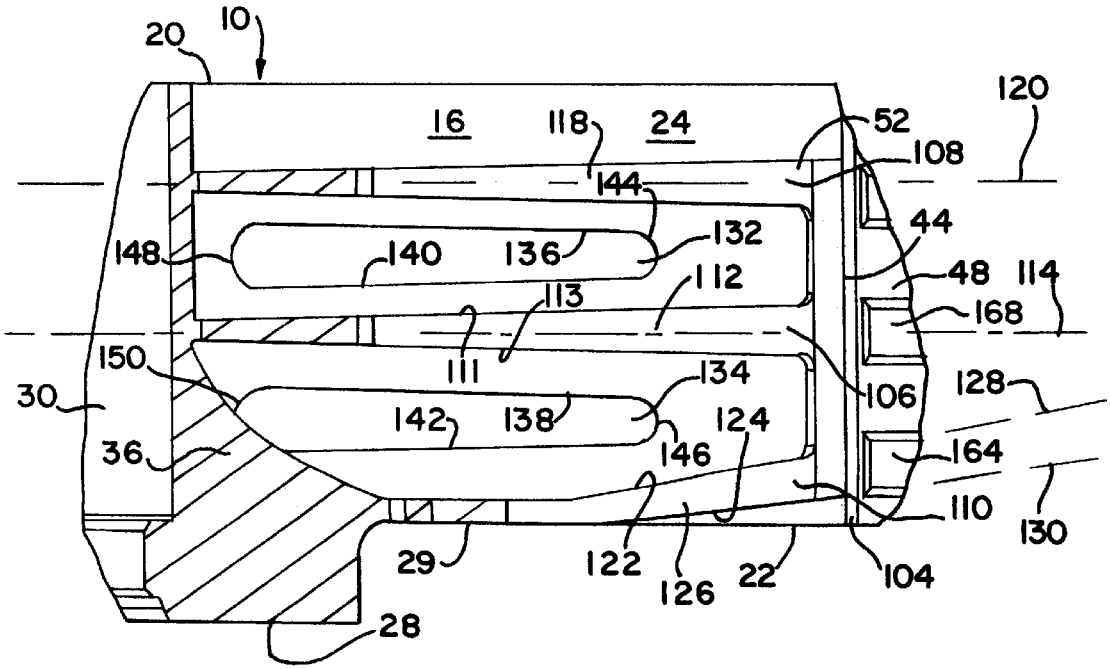
FIG. 11 is a cross-section taken along line 11—11 of FIG. 2, showing one of the rear rib sets.

The rear rib set 52 illustrated in FIG. 11 includes a rear central rib 106, a rear top rib 108 and a rear bottom rib 110. The rear central rib 106 extends from both rear stops 44, 46 toward the open member 30 and the back end 14 of the draft sill. The rear central rib 106 is connected to the side walls 16, 18 adjacent the rear stops 44, 46 and to the open member 30 and vertical ribs 32, 34. The rear central rib 106 has a horseshoe-shaped inward facing surface 112. The rear central rib 106 is symmetrical about a plane 114 along the theoretical force line, that is, the plane of the central axes 70 of the two key slots 68. The rear central rib 106 is also symmetrical about the central longitudinal plane 54 of the draft sill.

As shown in FIG. 3, a back center plate rib 116 is also symmetrical about the plane 114, and, as shown in FIG. 2, the back center plate rib 116 extends from the open member 30 to the side walls 16, 18 and toward the back end 14 of the draft sill. The back center plate rib 116 is also symmetrical about the central longitudinal plane 54 of the draft sill.

As shown in FIG. 11, the top and bottom surfaces 111, 113 of the rear central rib 106 taper toward each other and toward the plane 114 from the rib's widest portion at the rear stops 44, 46 to the most narrow portion at the open member 30.

The rear top rib 108 extends from both rear stops 44, 46 toward the open member 30 and toward the back end 14 of the draft sill. The rear top rib 108 connects to both side walls 16, 18 and to the open member 30 and vertical ribs 32, 34. The rear top rib 108 has a horseshoe-shaped inward facing surface 118. As shown in FIG. 11, the rear top rib 108 is symmetrical about a plane 120 parallel to plane 114. The rear top rib 108 is also symmetrical about the central longitudinal plane 54 of the draft sill. The rear top rib 108 is the only rib between the rear central rib 106 and the plane of the tops 20, 21 of the side walls 16, 18 rearward of the rear stops 44, 46.

The rear bottom rib 110 extends from both rear stops 44, 46 toward the open member 30 and toward the back end 14 of the draft sill. The rear bottom rib 110 is connected to both side walls 16, 18 and extends toward the bottoms 22, 23 of the side walls 16, 18. Opposite the rear stops 44, 46, the rear bottom rib 110 defines the bottom wall 29 of the draft sill. The bottom wall 29 connects the side walls 16, 18 and the center plate 28 depends from the bottom wall 29. The rear bottom rib 110 is symmetrical about the central longitudinal plane 54 of the draft sill.

The rear bottom rib 110 has the same features on both sides of the central plane 54, and it should be understood that the description of one side of the rear bottom rib 110 applies as well to the mirror-image opposite side of the rear bottom rib. As shown in FIG. 11, the rear bottom rib 110 has a top, bottom and inward-facing surface 122, 124, 126. The rear bottom rib 110 is shaped so that a plane 128 parallel with a length of the top surface 122 defines an acute angle with the planes 114, 120 and with the plane of the bottoms 22, 23 of the side walls 16, 18. In addition, a plane 130 parallel with a length of the bottom surface 124 of the rear bottom rib 110 defines an acute angle with the planes 114, 120 and with the plane of the bottoms 22, 23 of the side walls 16, 18. The rear bottom rib 110 is the only rib between the rear central rib 106 and the plane of the bottoms 22, 23 of the side walls 16, 18.

In the embodiment of FIGS. 1–4 and 11, the side walls 16, 18 each have two lightener holes 132, 134 between the rear stops 44, 46 and the open member 30. The top lightener hole 132 is between the rear central rib 106 and the rear top rib 108. The bottom lightener hole 134 is between the rear central rib 106 and the rear bottom rib 110. As shown in FIG. 11, each lightener hole 132, 134 is defined by top edges 136, 138 and bottom edges 140, 142 connected by front end radii 144, 146 and back end radii 148, 150. The top and bottom lightener holes 132, 134 are similarly shaped: the top edges 136, 138 are not parallel to the bottom edges 140, 142; instead, the top and bottom edges diverge outwardly from the front end radii 144, 146 to the back end radii 148, 150, following the contours of the ribs above and below the lightener holes. The side walls 16, 18 are free from welds along the edges 136, 138, 140, 142, 144, 146, 148, 150 of the lightener holes 132, 134. The lightener holes on the two side walls are mirror images of each other, and the description of the above lightener holes should be understood to apply to the lightener holes on the opposite side wall.

Figure 1:
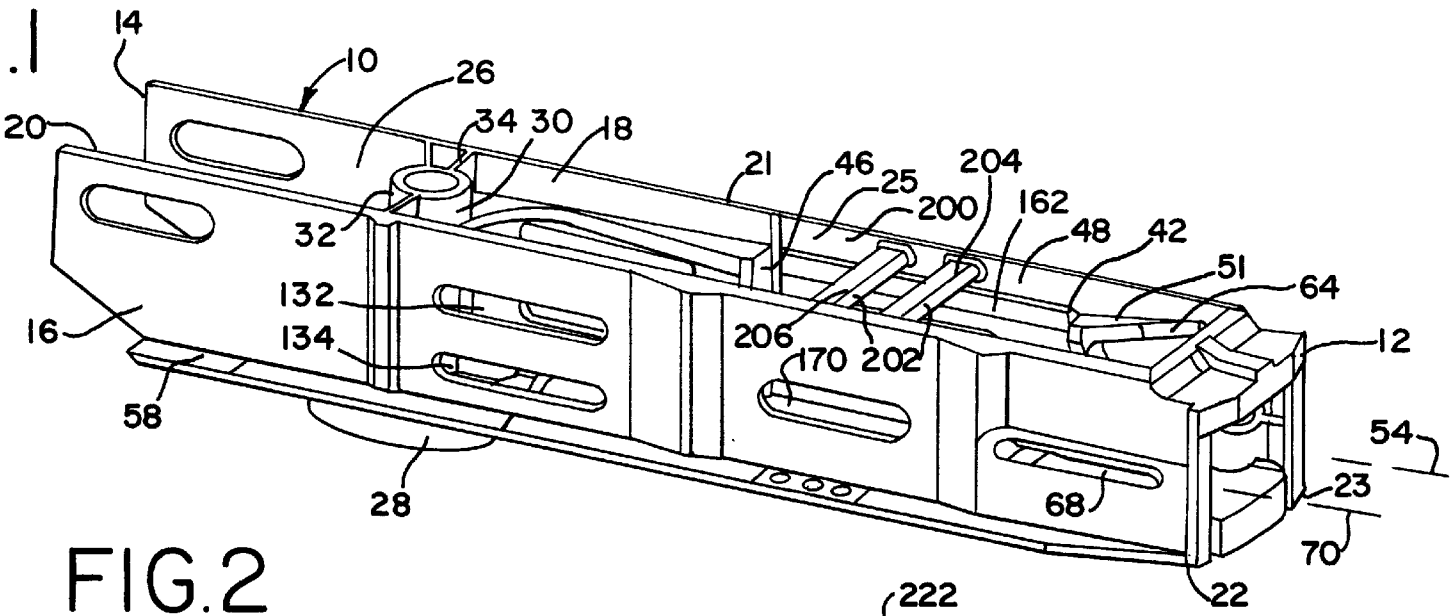
FIG. 1 is a perspective view of one embodiment of the cast draft sill of the present invention.
Figure 5:
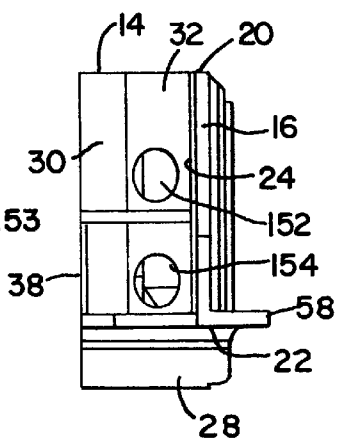
FIG. 5 is a half end view taken along line 5—5 of FIG. 2.

As shown in FIGS. 1–2 and 5, two of the vertical center plate ribs 32, 34 extend transversely from the side walls 16, 18 to the open member 30 and extend vertically from the center plate 28 upward the entire length of the open member 30. The two vertical center plate ribs 32, 34 meet the rear central rib 106 on their front faces and the back horizontal center plate rib 116 on their back faces. As shown in FIG. 5, vertical center plate rib 32 has one lightener hole 152 above the rear central rib 106 and back horizontal center plate rib 116, and one lightener hole 154 below the rear central rib 106 and back horizontal center plate rib 116. The other vertical center plate rib 34 has the same structure.

As shown in FIG. 3, the front vertical center plate rib 36 and back vertical center plate rib 38 extend upward from the center plate 28 along the open member 30 to the level of the rear central rib 106 and the back horizontal center plate rib 116, but no higher.

In the pocket 48 between the front stops 40, 42 and rear stops 44, 46, each side wall 16, 18 of the first illustrated draft sill has follower guide pads or pocket ribs 160. As shown in FIG. 3, the pocket ribs 160 include elongate rectangular top and bottom ribs 162, 164 that extend the substantial length of the pocket 48. Two short rectangular middle ribs 166, 168 are positioned between the top and bottom ribs 162, 164. Positioned between the middle ribs 166, 168 and between the top and bottom ribs 162, 164 is an elongate lightener hole 170. Although only one side wall 16 is shown in FIG. 3, it should be understood that the opposite side wall 18 has the same structures. The pocket ribs 162, 164, 166, 168 generally correspond with a thickening of the side walls 16, 18, and extend inwardly from the inner surfaces 24, 25 of the side walls 16, 18, providing an area of reduced dimension for receipt of draft gear or other structure. It should be understood that the shapes of the pocket ribs 162, 164, 166, 168 are shown for purposes of illustration only, and that other shapes may be used.

The illustrated lightener hole 170 is generally centered on the theoretical force line, that is, along the plane of the central axes 70 of the key slots 68. In the illustrated embodiment, the lightener hole 170 has a length of about 12 inches, a width of about 3 inches, and has ends with radii of 1.5 inches. Thus, the open area defined by the lightener hole 170 is about 34 square inches. Considering both side walls 16, 18, the total open area defined by the two lightener holes 170 is about 68 square inches. It should be understood that the size and shape of the illustrated lightener holes is provided for purposes of illustration only; other sizes and shapes may be used as well, although it is preferred to maximize the size of the lightener hole for weight reduction while maintaining adequate strength.

The draft sill of the embodiment of FIGS. 6–7 may have structures like those described in application Ser. No. 08,885,643 for the side walls, front and rear stops, center plate, and ribs. The reference numbers used in FIGS. 6–7 of the present invention embodiment are the same as those used for the embodiment of FIGS. 1–3 for corresponding parts, although the parts may have different features, as described above and in application Ser. No. 08/885,643.

As described in U.S. Pat. No. 5,931,101, there may be two lightener holes in the each side wall 16, 18 in the pocket 48. And as described in that patent, the front lightener hole in each side wall in the pocket may have an open area of about 32.78 square inches and the back lightener hole in each side wall in the pocket may have an open area of about 33.90 square inches. Thus, the two lightener holes in the side walls in the pocket between the plane of the front stops 40, 42 and plane of the rear stops 44, 46 have an open area of about 66.68 square inches. The total open area for both side walls in the pocket is more than about 130 square inches. The total open area is the pocket in the embodiment of FIGS. 6–7 can be increased to an even greater extent through use of open areas between the tops of the side walls. Thus, the total open area connecting the interior and exterior of the draft sill above the level of the top surfaces of the flanges and between planes through the front stops and rear stops is more than about 130 square inches.

In both of the illustrated embodiments, the draft sills include open areas 200 between the tops 20, 21 of the side walls 16, 18 in the area of the pocket 48 between the front stops 40, 42 and rear stops 44, 46. The open areas 200 are illustrated in FIGS. 1–2 and 6. In both of the illustrated embodiments, a metal span 202 connects the side walls 16, 18 between the front and rear stops. In both embodiments, the open area 200 has a total length, between the front stops 40, 42 and rear stops 44, 46 along the central longitudinal plane 54 of the draft sill, that is at least one-half the distance between the transverse plane 208 through at least parts of the front stops [208], referred to herein as the front stop plane, and the transverse plane 210 through at least parts of the rear stops [210], referred to herein as the rear stop plane. This feature is apparent from a review of FIGS. 1–2 and 6 of the present application and FIG. 18 of application Ser. No. 08/885,643.

It should be understood that although the open areas are shown as extending into the area of the pocket 48 between the front stops 40, 42 and rear stops 44, 46, the open areas 200 may also extend beyond the stops 40, 42, 44, 46, as shown in FIG. 1 for the first illustrated embodiment. In addition, the open areas 200 may be forward of the front stops 40, 42 and rearward of the rear stops 44, 46, but excluding the area between the front stops 40, 42 and rear stops 44, 46 (not shown). Generally, the open areas 200 are between the front end 12 and back end 14 of the draft sill.

In FIGS. 1–2 of the present application, the draft sill has an open top, with no top wall between the tops 20, 21 of the side walls 16, 18 from the front end 12 to the back end 14 of the draft sill. In the embodiment of FIGS. 1–2, the metal span 202 comprises a pair of spacer bars 204, 206 spaced slightly below the tops 20, 21 of the side walls 16, 18. The draft sill is open between the tops of the side walls 16, 18 from the spacer bars 204, 206 to the front end 12 of the draft sill and from the spacer bars 204, 206 to the open member 30. In the embodiment of FIGS. 1–2, the distance between the plane 208 of the front stops 40, 42 and the plane 210 of the rear stops 44, 46 is about 24½ inches, and each spacer bar 204, 206 has a width of about 3 inches. It should be understood that although two spacer bars 204, 206 are illustrated in FIGS. 1–3, the draft sill may have a single spacer bar or could have more than two spacer bars.

In the embodiment of FIG. 6, the metal span 202 comprises a top wall 212 connecting the two side walls 16, 18, and the open area 200 is defined by interior edges 214, 216 in the top wall 212, defining two lightener holes 218, 220 in the top wall. It can be seen from FIG. 6 that the total open area 200 along the central longitudinal plane 54 is at least about 70% of the distance between the front and rear stop planes 208, 210 at the front and rear stops.

It can also be seen from FIGS. 1–2 and 6 that the total width of the open area 200 in each embodiment along a transverse plane 222 is at least one-third the distance between the side walls 16, 18 along the transverse plane 222. The total width of the total open area 200 in each embodiment along the transverse plane 222 is also at least 40% of the distance between the side walls 16, 18 along the transverse plane 222. The transverse plane 222 extends across the open area 200 between the front and rear stop planes 208, 210, and parallel to the planes 208, 210. In the embodiment of FIGS. 1–3, the open area 200 spans the entire distance between the side walls 16, 18 along several transverse planes. In the embodiment of FIG. 6, the proportion of the widths of the lightener holes 218, 220 compared to the distance between the side walls 16, 18 is apparent from the drawing.

In both embodiments, the metal span 202 serves two functions. First, the metal span maintains desired spacing between the side walls 16, 18 during casting. It should be understood that for this first purpose, it is not necessary that the metal span be positioned as shown in FIGS. 1–3 and 6. Moreover, fewer or additional metal spans or spacers could be used for this purpose. And the metal spans or spacers need not be shaped as illustrated in FIGS. 1–3 and 6. To fulfill the first function, the metal spans or spacers should be sized, shaped and positioned to limit distortion of the side walls 16, 18 during casting so that the walls 16, 18 are cast at the desired spacing. Second, the metal spans in the illustrated embodiments also serve to provide an upper stop for the cushioning system received in the pocket 48: in the embodiment of FIGS. 1–3, the underside of the spacer bars 204, 206 provide an upper stop to maintain a cushioning system in the desired position with respect to the coupler force line, as shown in FIG. 8; in the embodiment of FIG. 6, the bottom surface 213 of the top wall 212 provides an upper stop to maintain the position of the cushioning system along the coupler force line, as shown in FIG. 9. Thus, as shown in FIGS. 8–9, the bottom surfaces 213 of the spacer bars and top wall are positioned to limit upward movement of cushioning system received in the pocket 48 between the front and rear stops. As used herein, "cushioning system" includes any yoke or similar device within the pocket 48, the draft gear itself, as well as other devices such as a buff gear assembly, hydraulic cushioning unit, for example. Generally, the spacer bars and top wall are positioned to meet AAR requirements for draft gear housings, such as providing a height of 12.375 inches.

In both embodiments, the front stops 40, 42, rear stops 44, 46, front rib sets 50, 51, rear rib sets 52, 53, side walls 16, 18 and metal span 202 comprise a unitary cast structure. The unitary cast structure may be made of suitable materials, such as Material Grade B+ cast steel. In casting, the various lightener holes may be used for core prints for supporting cores to define the interior of the draft sill. The bearing surface of the center plate 28 may be hardened to a BHN of 300 minimum, for example.

In both embodiments, the rear stop plane 210 is between the open member 30 and the front stop plane 208. The central longitudinal axis 31 of the open member 30 intersects the center plate. The vertical ribs 32, 34, 36, 38 are aligned with the center plate. The rear stop plane 210 lies between the vertical ribs 32, 34, 36, 38 and the front stop plane 208. At least part of at least one of the open member 30 and vertical ribs 32, 34, 36, 38 is between the side walls; in the illustrated embodiments, substantial parts of both the open member 30 and vertical ribs 32, 34, 36 38 are between the side walls.

In both the embodiments, the total weight of the draft sill, including the side walls, connecting metal, front and rear stops, front ribs, rear ribs, center plate, open member and ribs is not substantially greater than the weight of a comparable fabricated draft sill of substantially the same size and having side walls, front and rear stops, front ribs, rear ribs, a center plate, an open member and ribs extending outward from the open member. In both embodiments, the total weight of the cast draft sill structure is not greater than 1255 pounds (not including the shear plate). For example, the cast draft sill of the embodiment of FIGS. 1–3 may have a total weight of about 1000 pounds, or about 1025 pounds without the lightener holes 132, 134, compared to a comparable fabricated draft sill weighing about 1025 pounds (not including the shear plate). The cast draft sill of the embodiment of FIG. 6 may have a total weight of about 1230 pounds or less, compared to a comparable fabricated draft sill weighing about 1255 pounds, as disclosed in application Ser. No. 08/885,643.

Draft sills made in accordance with the present invention should exhibit improved stress distributions. With the integral structure of the draft sills of the present invention, connections without weld joints are possible, compared to fabricated draft sills of substantially the same size and having side walls, front and rear stops, front ribs, rear ribs, a center plate, an open member and ribs between the open member and center plate. Without weld joints, the cast draft sills of the present invention should have reduced stresses and a greater fatigue life compared to such fabricated draft sills. Such improvements can be shown through application of standard AAR formula and standard engineering stress and fatigue analyses.

Figure 4:
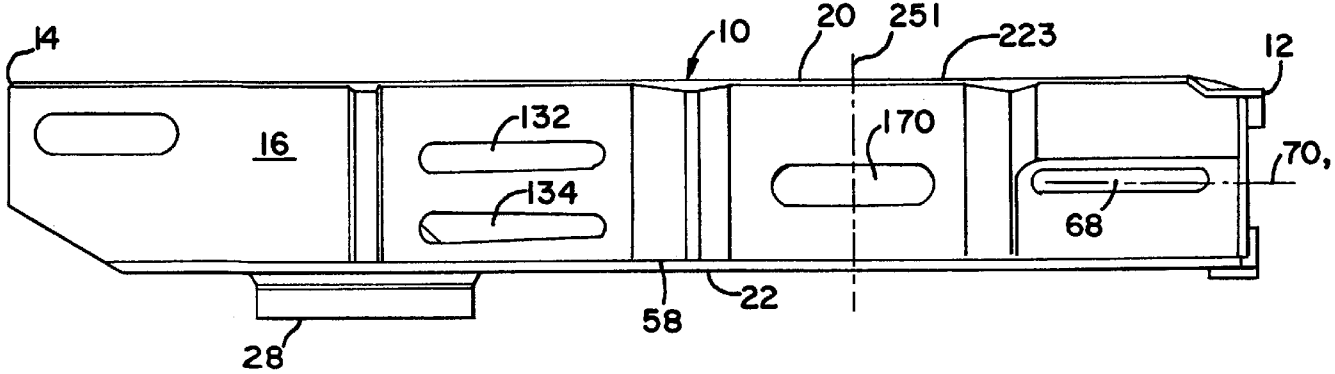
FIG. 4 is an elevation of the draft sill of FIGS. 1–3, shown welded to a shear plate.

To use either of the illustrated draft sills, the draft sill is placed against the shear plate on the railroad car body and welded in place. For the embodiment of FIGS. 1–3, the tops 20, 21 of the side walls 16, 18 are welded to the shear plate 223, as shown in FIG. 4. For the embodiment of FIGS. 6–7, the top wall 212 is placed against the shear plate and the draft sill is then welded to the shear plate.

For the draft sill of FIGS. 6–7, the position of the neutral axis should be at least as close to the coupler force line as the neutral axes shown in application Ser. No. 08/885,643 for the draft sills shown in FIGS. 5 and 9 of that application. For the embodiment of FIGS. 1–3 of the present application, the position of the neutral axis may be calculated using standard finite element analysis or 3-D modeling software, and one may determine that the neutral axis for the draft sill of FIGS. 1–3, when welded to the shear plate on the railroad car body, through the lightener holes 170 is 0.554 inches from the theoretical force line. The heutral. axis is shown at 250 in FIGS. 4 and 8, along plane 251, and the theoretical force line is shown at 253. The theoretical force line 253 corresponds with he plane 70.

In the draft sill of FIGS. 1–3 of the present application, the side wall heights, that is, the dimensions between the tops 20, 21 and bottoms 22, 23 of the side walls 16, 18, are larger than in the draft sills of application Ser. No. 08/885,643. The difference in heights of the side walls relate to differences in the railroad car structures and to differences in the corresponding fabricated draft sills. It should be understood that the present invention is not limited to any particular dimensions for the draft sill unless the claims expressly call for particular dimensions.

In the embodiment of FIGS. 1–3, the draft sill between the open member 30 and the back end 14 generally corresponds in size and shape with a corresponding fabricated sill. It should be understood that the present invention is not limited to such a structure unless expressly called for in the claims.

It should be understood that other features may be incorporated into either of the illustrated cast draft sills to further reduce the weight of the casting. For example, the flanges 58 at the bottoms 22, 23 of the side walls 16, 18 may have a thickness of ½ inch instead of ¾ inch. The thicknesses of the side walls 16, 18 could be tapered, such as from the open member 30 to the back end 14 of the draft sill. Other weight-saving features disclosed in application Ser. No. 08/885,643 may be incorporated into the design of the embodiment of FIGS. 1–3 of the present application.

While only specific embodiments of the invention have been described and shown, it is apparent that various alternatives and modifications can be made thereto. Those skilled in the art will also recognize that certain additions can be made to the illustrative embodiments. It is, therefore, the intention in the appended claims to cover all such alternatives, modifications and additions as may fall within the true scope of the invention.

What is claimed is:

1. A draft sill to receive a shank of a device for connecting one railroad car to another, the draft sill comprising:

a front end and a back end;

a pair of spaced side walls, each side wall having a top and a bottom, the side walls having facing inner surfaces, the side walls extending substantially from the front end to the back end of the draft sill, at least parts of the tops of the side walls lying in a top plane;

the draft sill having a central longitudinal plane between the side walls;

a center plate;

an open member positioned along the central longitudinal plane of the draft sill and having a generally vertical central longitudinal axis intersecting said center plate, the central longitudinal axis of the open member extending between the side walls between the front and back end of the draft sill;

a plurality of generally vertical ribs;

a pair of front stops, one front stop on the inner surface of each side wall, at least parts of said front stops being aligned along a front stop plane intersecting said draft sill central longitudinal plane;

a pair of rear stops, one rear stop on the inner surface of each side wall, at least parts of said rear stops being aligned along a rear stop plane intersecting said draft sill central longitudinal plane;

the front and rear stops being spaced apart, the front stop plane being between the rear stop plane and the front end of the draft sill, the rear stop plane being between the back end of the draft sill and the front stop plane, the rear stop plane being between the vertical ribs and the front stop plane and the rear stop plane being between the open member and the front stop plane;

a front rib set extending from each front stop to the inner surface of the adjacent side wall and toward the front end of the draft sill;

a rear rib set extending from each rear stop to the inner surface of the adjacent side wall and toward the back end of the draft sill;

a flange extending outward from the bottom of each side wall, each flange having a top surface and a bottom surface;

the draft sill having an interior between the inner surfaces of the side walls, an exterior beyond the side walls and beyond the top plane, and at least one open area connecting the interior of the draft sill and the exterior of the draft sill, said open area being above the level of the top surfaces of the flanges and including at least one open area between the tops of the side walls and between the front stop plane and rear stop plane, the draft sill further including at least one metal span connecting the side walls;

wherein the total open area connecting the interior and exterior of the draft sill above the level of the top surfaces of the flanges and between said front stop plane and a position inward of said back end of the draft sill is at least 130 square inches;

wherein at least the front stops, rear stops, front and rear rib sets, side walls and metal span comprise a unitary cast structure;

and wherein the total weight of the draft sill including the side walls, connecting metal span, front and rear stops, front and rear rib sets, center plate, open member and vertical ribs is not substantially greater than the weight of a comparable fabricated draft sill of substantially the same size and having side walls, front and rear stops, front and rear rib sets, a center plate, an open member and vertical ribs.

2. The cast draft sill of claim 1 wherein the open area between the tops of the side walls between the front and rear stops has a total length along the central longitudinal plane of the draft sill that is at least one-half the distance between the planes of the front and rear stops.

3. The draft sill of claim 2 wherein the open area between the tops of the side walls along a transverse plane between the front and rear stops and intersecting the side walls and open area has a width that is at least one-third of the distance between the side walls along the transverse plane.

4. The draft sill of claim 2 wherein the cast metal span is at the tops of the side walls and defines a top wall having edges defining the open area, the edges and open area being spaced from the side walls.

5. The draft sill of claim 4 wherein the open area comprises a plurality of lightener holes and the span of material comprises a top wall of the cast draft sill.

6. The cast draft sill of claim 1 wherein the railway car has a center sill with two ends, the draft sill to be positioned at one end of the center sill.

7. The draft sill of claim 1 wherein the cast draft sill has lightener holes in the side walls between the front and rear stops.

8. The draft sill of claim 1 wherein the center plate, open member and ribs are cast as a unitary structure with the side walls of the draft sill.

9. The draft sill of claim 1 wherein there are two front rib sets, each front rib set comprising:

top and bottom key slot ribs extending from the front stop toward the front end of the draft sill, the top and bottom key slot ribs having spaced substantially parallel surfaces separated by a key slot in the side wall;

a front top rib extending from the front stop toward the front end of the draft sill, the front top rib having a bottom surface and being shaped so that a plane parallel with a length of the bottom surface of the front top rib defines an acute angle with the plane of the central axes of the key slots, the front top rib being the only rib between the top key slot rib and the top of the side wall;

a front bottom rib extending from the front stop toward the front end of the draft sill, the front bottom rib having a top surface and being shaped so that a plane parallel with a length of the top surface of the front bottom rib defines an acute angle with the plane of the central axes of the key slots, the front bottom rib being the only rib between the bottom key slot rib and the bottom of the side wall.

10. The draft sill of claim 9 wherein the front bottom rib has a bottom surface and the front bottom rib is shaped so that a plane parallel with a length of the front bottom rib bottom surface defines an acute angle with the plane of the bottoms of the side walls, the front bottom rib surface meeting the front stop at a position spaced from the plane of the bottoms of the side walls.

11. The cast draft sill of claim 1 wherein the rear rib set comprises:

a rear central rib extending from both of said rear stops toward the open member, the rear central rib having top and bottom surfaces;

a rear top rib extending from both the rear stops toward the open member, the rear top rib having top and bottom surfaces and being the only rib between the rear central rib and the tops of the side walls; and a rear bottom rib extending from both rear stops toward the open member, the rear bottom rib having top and bottom surfaces and being the only rib between the rear central rib and the bottom edge of the side walls, the rear bottom rib defining a bottom wall connecting the side walls and from which the center plate depends.

12. The draft sill of claim 1 wherein the cast metal span has a bottom surface and wherein the bottom surface of the span is positioned to provide a limit upward movement of a cushioning system received in the draft sill between the front and rear stops.

13. The draft sill of claim 1 wherein the cast draft sill including the center plate, ribs and open member weighs less than 1255 pounds.

14. The draft sill of claim 1 wherein said open member and vertical ribs are cast integral with said center plate.

15. The draft sill of claim 1 wherein:

the central longitudinal axis of the open member lies in a transverse center plate plane parallel to the front stop plane and rear stop plane and between the rear stop plane and the back end of the draft sill;

the interior surfaces of the side walls, front stop plane and rear stop plane define a draft gear pocket between the interior surfaces of the side walls, front stop plane and rear stop plane; and a horizontal plane extends perpendicular to the central longitudinal plane and front and rear stop planes, said horizontal plane intersecting each side wall midway between the top and bottom of the side wall in the draft gear pocket, said horizontal plane also intersecting each side wall along said transverse center plate plane.

16. The draft sill of claim 1 wherein the railway car has a center sill with two ends, the draft sill to be positioned at one end of the center sill.

17. The draft sill of claim 1 wherein the total open area connecting the interior and exterior of the draft sill above the level of the top surfaces of the flanges and between said front stop plane and said rear stop plane of the draft sill is at least 130 square inches.

18. A draft sill to receive a shank of a device for connecting one railroad car to another, the draft sill comprising:

a front end and a back end;

a pair of spaced side walls, each side wall having a top and a bottom, at least parts of the tops of the side walls lying in a top plane, the two side walls having facing inner surfaces and exterior surfaces, the side walls extending substantially from the front end to the back end of the draft sill;

the draft sill having a central longitudinal plane between the side walls;

a center plate;

an open member positioned along the central longitudinal plane of the draft sill and having a generally vertical central longitudinal axis intersecting said center plate;

a plurality of generally vertical ribs;

a pair of front stops, one front stop on the inner surface of each side wall, at least parts of said front stops being aligned along a front stop plane;

a pair of rear stops, one rear stop on the inner surface of each side wall, at least parts of said rear stops being aligned along a rear stop plane;

the front and rear stops being spaced apart, the front stop plane being between the rear stop plane and the front end of the draft sill, the rear stop plane being between the back end of the draft sill and the front stop plane, the rear stop plane being between the vertical ribs and the front stop plane, and the rear stop plane being between the open member and the front stop plane;

a front rib set extending from each front stop to the adjacent side wall and toward the front end of the draft sill;

a rear rib set extending from each rear stop to the adjacent side wall and toward the back end of the draft sill;

a flange extending outward from the bottom of each side wall, each flange having a top surface and a bottom surface;

the draft sill having an interior between the inner surfaces of the side walls, an exterior beyond the exterior surfaces of the side walls and beyond the top plane, and at least one open area connecting the interior and the exterior of the draft sill;

the draft sill including at least one metal span connecting the side walls;

wherein the total open area connecting the interior and exterior of the draft sill above the level of the top surfaces of the flanges and between the front stop plane and a position inward of the back end of the draft sill is at least 130 square inches;

wherein the total open area connecting the interior and exterior of the draft sill above the level of the top surfaces of the flanges includes at least one open area between the front stop plane and the rear stop plane and between the tops of the side walls;

wherein at least part of at least one of said open member and said vertical ribs lies between the side walls;

wherein at least the front stops, rear stops, front and rear rib sets, side walls and metal span comprise a unitary cast structure;

and wherein the total weight of the draft sill including the side walls, connecting metal span, front and rear stops, front and rear rib sets, center plate, open member and vertical ribs is not greater than 1255 pounds.

19. The draft sill of claim 18 wherein each side wall has an open area in the draft pocket between the front and rear stops greater than 19.09 square inches.

20. The cast draft sill of claim 18 wherein the open area between the tops of the side walls between the front and rear stops has a total length along the central longitudinal plane of the draft sill that is at least one-half the distance between the planes of the front and rear stops.

21. The draft sill of claim 20 wherein the open area between the tops of the side walls along a transverse plane between the front and rear stops and intersecting the side walls and open area has a width that is at least one-third of the distance between the side walls along the transverse plane.

22. The draft sill of claim 18 wherein the cast metal span is at the tops of the side walls and defines a top wall having edges defining the open area, the edges and open area being spaced from the side walls.

23. The draft sill of claim 22 wherein the open area comprises a plurality of lightener holes and the span of material comprises a top wall of the cast draft sill.

24. The draft sill of claim 18 wherein the center plate, open member and ribs are cast as a unitary structure with the side walls of the draft sill.

25. The draft sill of claim 18 wherein there are two front rib sets, each front rib set comprising:

top and bottom key slot ribs extending from the front stop toward the front end of the draft sill, the top and bottom key slot ribs having spaced substantially parallel surfaces separated by a key slot in the side wall;

a front top rib extending from the front stop toward the front end of the draft sill, the front top rib having a bottom surface and being shaped so that a plane parallel with a length of the bottom surface of the front top rib defines an acute angle with the plane of the central axes of the key slots, the front top rib being the only rib between the top key slot rib and the top of the side wall;

a front bottom rib extending from the front stop toward the front end of the draft sill, the front bottom rib having a top surface and being shaped so that a plane parallel with a length of the top surface of the front bottom rib defines an acute angle with the plane of the central axes of the key slots, the front bottom rib being the only rib between the bottom key slot rib and the bottom of the side wall.

26. The draft sill of claim 25 wherein the front bottom rib has a bottom surface and the front bottom rib is shaped so that a plane parallel with a length of the front bottom rib bottom surface defines an acute angle with the plane of the bottoms of the side walls, the front bottom rib surface meeting the front stop at a position spaced from the plane of the bottoms of the side walls.

27. The draft sill of claim 18 wherein the rear rib set comprises:

a rear central rib extending from the both rear stops toward the open member, the rear central rib having top and bottom surfaces;

a rear top rib extending from both the rear stops toward the open member, the rear top rib having top and bottom surfaces and being the only rib between the rear central rib and the tops of the side walls; and a rear bottom rib extending from both rear stops toward the open member, the rear bottom rib having top and bottom surfaces and being the only rib between the rear central rib and the bottom edges of the side walls, the rear bottom rib defining a bottom wall connecting the side walls and from which the center plate depends.

28. The draft sill of claim 18 wherein the cast metal span has a bottom surface and wherein the bottom surface of the span is positioned to provide a limit upward movement of a cushioning system received in the draft sill between the front and rear stops.

29. The draft sill of claim 18 wherein the neutral axis in at least one plane in the draft pocket is less than 0.6 inches above the theoretical force line in that plane.

30. The draft sill of claim 29 wherein the neutral axis in that plane is less than 0.5 inches above the theoretical force line in that plane.

31. The draft sill of claim 18 wherein said open member and vertical ribs are cast integral with said center plate.

32. The draft sill of claim 18 wherein the total open area connecting the interior and exterior of the draft sill above the level of the top surfaces of the flanges and between the front stop plane and rear stop plane is at least 130 square inches.

33. A draft sill of relatively lightweight construction for use with a railway car having a center sill with two ends, the draft sill to be positioned at one end of the center sill, the draft sill comprising:

a front end and a back end;

a pair of spaced side walls, each side wall having a top and a bottom, at least parts of the tops of the side walls lying in a top plane, the side walls having facing inner surfaces and exterior surfaces, the facing inner surfaces of the side walls defining an interior of the draft sill, the draft sill having an exterior beyond the exterior surfaces of the side walls and the top plane;

a draft sill central longitudinal plane between the side walls;

a pair of front stops, one front stop on the inner surface of each side wall, at least parts of said front stops being aligned along a front stop plane intersecting said draft sill central longitudinal plane;

a pair of rear stops, one rear stop on the inner surface of each side wall, at least parts of said rear stops being aligned along a rear stop plane intersecting said draft sill central longitudinal plane;

the front and rear stops being spaced apart, the front stops being between the rear stops and the front end of the draft sill, the rear stops being between the back end of the draft sill and the front stops;

a center plate;

an open member aligned with the center plate;

the draft sill having at least one open area between the tops of the side walls connecting the interior of the draft sill and the exterior of the draft sill, the draft sill having at least one metal span connecting the side walls;

wherein at least the front stops, rear stops, side walls and metal span comprise a unitary cast draft sill structure;

wherein the draft sill central longitudinal plane intersects the open area between the tops of the side walls and the total open area between the tops of the side walls along the draft sill central longitudinal plane an d between the front stop plane and rear stop plane has a total length along the draft sill central longitudinal plane that is at least one half the distance between the planes of the front and rear stops;

wherein the total open area between the tops of the side walls along a transverse plane intersecting the side walls and open area between the front stop plane and rear stop plane has a total width along the transverse plane that is at least one-third the distance between the side walls along the transverse plane;

wherein the open member has a central longitudinal axis that extends between the side walls of the draft sill; and wherein the total open area connecting the interior and the exterior of the draft sill between the front stop plane and rear stop plane is at least 130 square inches.

34. The draft sill of claim 33 further including holes in said side walls of said draft sill.

35. The draft sill of claim 33 wherein each side wall includes an open area between the front stop plane and the rear stop plane, the total open area in the side walls between the front stop plane the rear stop plane being greater than 130 square inches.

36. The draft sill of claim 33 further comprising front and rear rib sets and vertical ribs and wherein the total weight of the draft sill including the side walls, connecting metal span, front and rear stops, front and rear rib sets, center plate, open member and vertical ribs is not greater than 1255 pounds.

37. The draft sill of claim 33 wherein the open area between the tops of the side walls along a transverse plane intersecting the side walls has a total width that is at least about 40% of the distance between the side walls along the transverse plane.

38. The draft sill of claim 33 wherein said open member and vertical ribs are cast integral with said center plate.

39. The draft sill of claim 33 including a top wall extending between the tops of the side walls, wherein there are two holes in the top wall defining the open area, said two holes being positioned along the draft sill central longitudinal plane, said total length of the open area comprising the sum of the lengths of said two holes along said central longitudinal plane, and wherein a part of the top wall defines said metal span.

40. A draft sill of relatively lightweight construction for use with a railway car having a center sill with two ends, the draft sill to be positioned at one end of the center sill, the draft sill comprising:

a front end and a back end;

a pair of spaced side walls, each side wall having a top and a bottom, at least parts of the tops of the side walls lying in a top plane, the side walls having facing inner surfaces and exterior surfaces;

the draft sill having a central longitudinal plane between the side walls;

a center plate positioned along the central longitudinal plane and having a longitudinal dimension and a transverse dimension;

an open member positioned along the central longitudinal plane of the draft sill and having a generally vertical central longitudinal axis intersecting said center plate;

a pair of front stops, one front stop on the inner surface of each side wall, at least parts of said front stops being aligned along a front stop plane intersecting said draft sill central longitudinal plane;

a pair of rear stops, one rear stop on the inner surface of each side wall, at least parts of said rear stops being aligned along a rear stop plane intersecting said draft sill central longitudinal plane;

the front and rear stops being spaced apart, the front stop plane being between the rear stop plane and the front end of the draft sill, the rear stop plane being between the back end of the draft sill and the front stop plane, the rear stop plane being between the open member and the front stop plane and the central longitudinal axis of the open member being between the rear stop plane and the back end of the draft sill;

a front rib set extending from each front stop to the inner surface of the adjacent side wall and toward the front end of the draft sill;

a rear rib set extending from each rear stop to the inner surface of the adjacent side wall and toward the back end of the draft sill;

the central longitudinal axis of the open member lying in a transverse center plate plane parallel to the front stop plane and rear stop plane and between the rear stop plane and back end of the draft sill;

a flange extending outward from the bottom of each side wall, each flange having a top surface and a bottom surface;

the draft sill having a transverse dimension along said transverse center plate plane, the maximum transverse dimension of said draft sill exclusive of the flanges along said transverse center plate plane being less than the maximum transverse dimension of said draft sill including the flanges and along said transverse center plate plane;

the draft sill having an interior between the inner surfaces of the side walls, an exterior beyond the exterior surfaces of the side walls and beyond the top plane, and at least one open area connecting the interior of the draft sill and the exterior of the draft sill, said open area being above the level of the top surfaces of the flanges;

wherein the total open area connecting the interior and exterior of the draft sill above the level of the top surfaces of the flanges and between said front stop plane and the rear stop plane is at least 130 square inches;

wherein the total open area connecting the interior and exterior of the draft sill above the level of the top surfaces of the flanges includes at least one open area between the front stop plane and the rear stop plane and between the tops of the side walls; and wherein at least the front stops, rear stops, front and rear rib sets, side walls, flanges and metal span comprise a unitary cast structure.

41. The draft sill of claim 40 wherein:

the interior surfaces of the side walls, front stop plane and rear stop plane define a draft gear pocket between the interior surfaces of the side walls, front stop plane and rear stop plane; and a horizontal plane extends perpendicular to the central longitudinal plane and front and rear stop planes, said horizontal plane intersecting each side wall midway between the top and bottom of the side wall in the draft gear pocket, said horizontal plane also intersecting each side wall along said transverse center plate plane.

42. The draft sill of claim 40 further comprising vertical ribs extending upward from the center plate, and wherein the total weight of the draft sill including side walls, connecting metal span, front and rear stop, front and rear rib sets, center plate, open member and vertical ribs is not greater than 1255 pounds.

* * * * *